US006777605B2

(12) United States Patent
Wenjun

(10) Patent No.: US 6,777,605 B2
(45) Date of Patent: Aug. 17, 2004

(54) KEYBOARD INSTRUMENT

(75) Inventor: Pu Wenjun, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 10/341,418

(22) Filed: Jan. 14, 2003

(65) Prior Publication Data

US 2003/0131711 A1 Jul. 17, 2003

(30) Foreign Application Priority Data

Jan. 17, 2002 (JP) ..... 2002-009053

(51) Int. Cl.[7] ..... G10D 13/02
(52) U.S. Cl. ..... 84/423 R; 84/409
(58) Field of Search ..... 84/423 R, 430, 84/433, 432, 435, 436, 438, 424, 427, 434, 335, 439

(56) References Cited

U.S. PATENT DOCUMENTS 5,895,875 A * 4/1999 Osuga et al. ..... 84/423 R
6,054,641 A 4/2000 Inoue
6,248,943 B1 * 6/2001 Inoue ..... 84/423 R

* cited by examiner

*Primary Examiner*—Kimberly Lockett
(74) *Attorney, Agent, or Firm*—Dickstein, Shapiro, Morin & Oshinsky, LLP.

(57) ABSTRACT

A keyboard instrument such as an electronic piano comprises a keyboard structure that is basically identical to the keyboard structure of an upright piano except hammer assemblies and a struck portion attached to an action bracket. Each of the hammer assemblies is constituted by a hammer shank and a pseudo hammer, one of which is used to strike the struck portion having a multilayer structure including an elastic member (e.g., a plate spring) sandwiched between buffer materials. The elastic member has a prescribed number of striking areas in correspondence with keys arranged on a keybed, wherein the striking areas are gradually increased in weights and bends (or deflections) in a pitch descending order from higher pitches to lower pitches. Thus, it is possible to simulate weight factors and bends (or deflections) of strings actually struck by hammer felts in an upright piano.

29 Claims, 11 Drawing Sheets

KEYBOARD INSTRUMENT

BACKGROUND OF THE INVENTION

1. Field of the Invention

This invention relates to keyboard instruments such as electronic pianos that reproduce real key-touch responses (or key-touch feelings or sensations) of acoustic pianos.

2. Description of the Related Art

Conventionally, various types of electronic pianos have been developed and equipped with keyboard mechanisms or structures that can reproduce key-touch responses similar to those produced by keyboards of acoustic pianos.

FIG. 12 is a side view showing an example of a keyboard structure conventionally employed in an electronic piano. That is, a keyboard structure A is basically constituted by a keyboard B containing a prescribed number of keys, a hammer assembly C, an action mechanism D for rotating the hammer assembly C, and a struck portion E struck by the 'rotated' hammer assembly C. Herein, the action mechanism D substantially corresponds to the known action mechanism of an upright piano.

The hammer assembly C is constituted by a hammer shank C1 and a pseudo hammer C2 that corresponds to a hammer felt of an upright piano. The pseudo hammer C2 is arranged in order to substantially match the weight and balance position (i.e., center of gravity) of the hammer assembly C with those of the hammer assembly of an upright piano. Therefore, the pseudo hammer C2 does not actually strike the struck portion E, but the hammer shank C1 actually strikes the struck portion E.

Actually, an electronic piano comprises sensors and a sound source device (not shown), wherein the sensors detect motions of keys of the keyboard B, and the sound source device is activated to produce electronic sounds based on detection results of the sensors. Thus, the electronic piano can produce prescribed electronic sounds simulating real sounds of an acoustic piano that are produced upon depression of keys causing hammer felts to strike strings.

As described above, the aforementioned electronic piano employs the action mechanism D similar to that of an acoustic piano, and the hammer assembly C that is designed to simulate the weight and balance position of the hammer assembly of an acoustic piano. Therefore, it is possible to produce substantially the same key-touch response of an acoustic piano, wherein the electronic piano can be adjusted in tone volume of sound and produce sound via a headphone set, for example.

The struck portion E is provided mainly for the purpose of reducing striking noise. For this reason, the struck portion E is composed of two sheets of buffer materials such as felts, which are used commonly for all keys of the keyboard B.

This indicates that substantially the same key-touch response is provided with respect to all keys (or registers) of the keyboard B when depressed. In contrast, an acoustic piano produces various key-touch responses with respect to various registers of the keyboard due to arrangement of different types of strings that differ in thickness, material, and tension. Because of the use of buffer materials, the struck portion E may gradually reduce striking force of the hammer assembly C. Therefore, there is a problem in that the key-touch responses produced by the electronic piano upon depression of keys may greatly differ from key-touch responses of an acoustic piano upon depression of keys causing hammer felts to strike strings.

In short, because the aforementioned keyboard instrument such as an electronic piano does not have strings that are struck by hammer felts in an acoustic piano, it may be very difficult to reproduce or accurately simulate real key-touch responses of an acoustic piano, which depend upon deflections (or bends) and weights of strings.

SUMMARY OF THE INVENTION

It is an object of the invention to provide a keyboard instrument that can reproduce real key-touch responses, which are produced by an acoustic piano upon depression of keys activating hammer felts to strike strings.

A keyboard instrument such as an electronic piano comprises a keyboard structure that is basically identical to the keyboard structure of an upright piano or the like except hammer assemblies and a struck portion attached to an action bracket. Each of the hammer assemblies is constituted by a hammer shank and a pseudo hammer, one of which is used to strike the struck portion having a multilayer structure including an elastic member (e.g., a plate spring) sandwiched between buffer materials. The elastic member has a prescribed number of striking areas in correspondence with keys arranged on a keybed, wherein the striking areas are gradually increased in weights and bends (or deflections) in a pitch descending order from higher pitches to lower pitches. Concretely, the striking areas are gradually decreased in rigidities (or spring constants) in the pitch descending order. Thus, it is possible to simulate weight factors and bends (or deflections) of strings actually struck by hammer felts in an upright piano, for example.

Upon depression of the keys, the hammer assemblies are rotatably moved towards the struck portion, so that the hammer shanks actually strike the striking areas of the struck portion, wherein the pseudo hammers are used as deadweights actualizing desired weights and balance positions (i.e., center of gravity) of the hammer assemblies in relation to the keys, so that it is possible to simulate key-touch responses of keys of an upright piano. Due to the provision of the buffer materials such as felts, urethanes, leathers, cloths, and synthetic resins, it is possible to optimally reduce striking forces of the hammer assemblies, which in turn contribute to improvements in durability with respect to the hammer assemblies and struck portion.

The elastic member is made of a synthetic resin, or a prescribed metal material that is selected from among stainless steel, nickel silver, phosphor bronze, and brass, for example. In addition, the elastic member has a comb-like opening in which the striking areas are formed between comb teeth respectively and they are gradually increased in dimensions such as lengths in the pitch descending order from higher pitches to lower pitches. Furthermore, the striking areas of the elastic member are curved relative to the hammer assemblies in correspondence with the keys.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

1. Constitution of Embodiment

Figure 1:
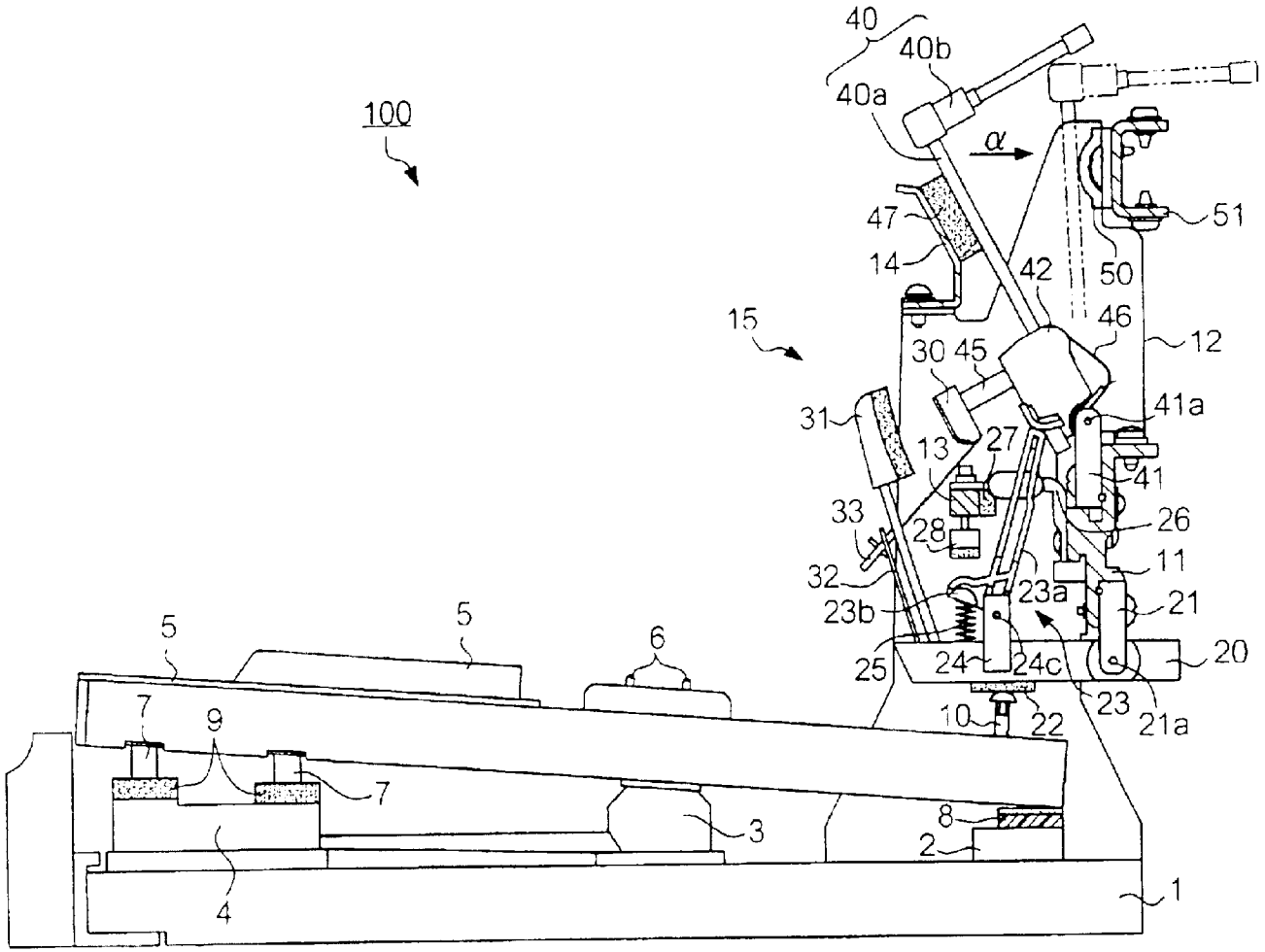
FIG. 1 is a side view partly in cross section showing a keyboard structure of an electronic piano in accordance with a preferred embodiment of the invention.

The preferred embodiment of this invention is described with respect to an electronic piano having a keyboard structure exclusively designed therefor, which includes keys and an action mechanism of an upright piano. FIG. 1 is a side view partly in cross section showing a keyboard structure 100 of an electronic piano. The overall structure and mechanism of the electronic piano of the present embodiment are substantially identical to those of the conventional electronic piano except the keyboard structure 100, which is exclusively designed therefor. Hence, the following description is given mainly with respect to the keyboard structure 100.

On a keybed 1 in a length direction, there are arranged a back rail 2, a balance rail 3, and a front rail 4, all of which are elongated over the overall width of the keyboard structure 100 of the electronic piano. Keys (i.e., white keys and black keys) 5 are each supported by balance key pins 6, which are attached to the balance rail 3, so that they can be freely moved up and down pivotally about the balance key pins 6. In addition, the keys 5 are each regulated in horizontal movement or swing in left-right directions on the keybed 1 by front pins 7, which are attached to the front rail 4. Normally, the keys 5 are each brought into contact with a back rail cloth 8, which is attached to the back rail 2, when not depressed. When depressed, each key 5 is rotated downwardly to come in contact with a front pin cloth punching 9, which is attached to the front rail 4, so that the backend portion thereof urges a whippen (or an action lever) to rotate upwardly via a capstan 10.

The aforementioned electronic piano has sensors (not shown) that are arranged beneath the keys 5 to detect depression, depressing force, and depressing velocity. That is, these sensors detect motions of the keys 5 respectively. Output signals of the sensors are supplied to a sound source device (not shown), which in turn produces musical tones via speakers or a headphone set, wherein musical tones have specific tone colors and tone pitches as well as tone volumes that depend upon depressing forces or depressing velocities of the keys 5. The aforementioned sensors are constituted in such a way that piezoelectric elements directly struck by the keys 5 are arranged on the keybed 1, or optical sensors such as photo-interrupters are arranged on the keybed 1, and shutters are arranged beneath the keys 5 to traverse optical axes of optical sensors when closed upon depression of the keys 5. When optical sensors are used, it is possible to measure key-depression velocities based on time intervals in which optical sensors receive light after shutters block optical axes in transmission of light.

Action brackets 12 are periodically arranged by prescribed distances therebetween on a center rail 11, which is elongated over the overall width of the keyboard structure 100 of the electronic piano. Action mechanisms 15 are respectively arranged between the action brackets 12 with respect to the keys 5.

Specifically, whippen flanges 21 are attached to the center rail 11 with respect to the keys 5 respectively, so that the whippen 20 is rotatably supported by the whippen flanges 21 via pins 21*a*. In addition, a whippen heel cloth 22 that the capstans 10 are brought into contact with is attached to the lower surface of the whippen 20. Jack flanges 24 for rotatably supporting bent portions of roughly L-shaped jacks 23 via pins 24*c* are attached to prescribed positions of the whippen 20 substantially relative to the capstans 10, which are brought into contact with the heel cloth 22 attached to the lower surface of the whippen 20. Jack springs 25 are arranged on the whippen 20 and push the jacks 23 to rotate in the clockwise direction in FIG. 1. Furthermore, back checks 31 interconnected with bridle wires 32 are arranged in the front side of the whippen 20 to elastically receive catchers 30 when moved upon depression of the keys 5.

In the above, the bridle wire 32 and the catcher 30 are interconnected together by a bridle tape 33, so that the restoration movement of a hammer assembly 40 is interlocked with the restoration movement of the whippen 20. Herein, the bridle tape 33 is arranged to avoid unwanted double striking of a struck portion 50 due to the rebound of the hammer assembly 40.

A regulating rail 13, which is elongated over the overall width of the keyboard of the electronic piano, is attached to the center rail 11 via regulating brackets 26. In addition, the regulating rail 13 has jack stop felts 27 and regulating buttons 28 in connection with the jacks 23, the number of which corresponds to the number of the keys 5, wherein when the whippen 20 is rotated upwardly, large jack portions 23*a* are brought into contact with the jack stop felts 27, and small jack portions 23*b* are brought into contact with the regulating button 28.

Butts 42 are rotatably supported by butt flanges 41, which are attached to the center rail 11, via center pins 41*a*. Hammer assemblics 40 are attached to the butts 42. In addition, catchers 30 are attached to the butts 42 via catcher shanks 45. The butts 42 are forced to rotate in a counterclockwise direction in FIG. 1 by butt springs 46, so that the hammer assemblies 40 are normally brought into contact with hammer pads 47, that are affixed to hammer rails 14 fixed to front portions of action brackets 12, in response to the normal positions of the keys 5 that are not depressed.

Figure 2:
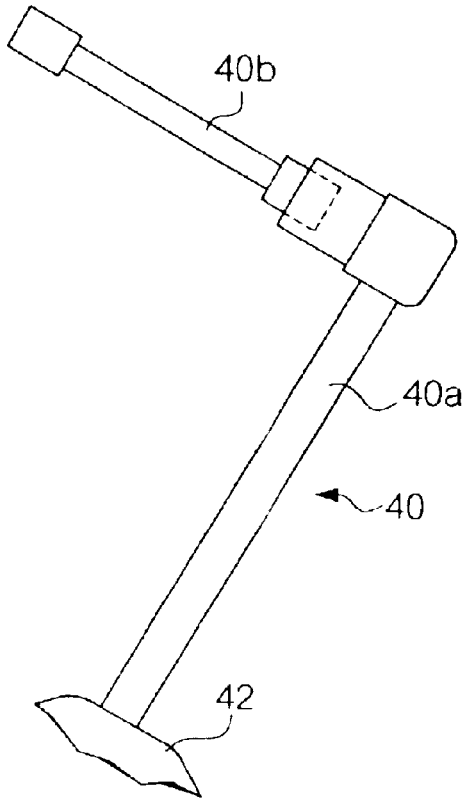
FIG. 2 is a side view showing a hammer assembly consisting of a hammer shank and a pseudo hammer.
Figure 3A:
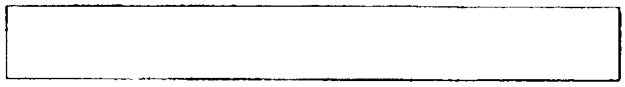
FIG. 3A is an example of the pseudo hammer realizing a prescribed weight for the hammer assembly.
Figure 3B:
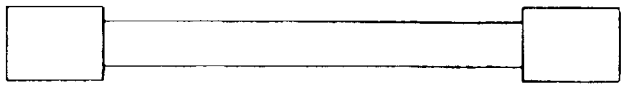
FIG. 3B is another example of the pseudo hammer realizing a prescribed weight for the hammer assembly.
Figure 3C:
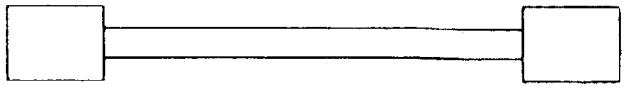
FIG. 3C is a further example of the pseudo hammer realizing a prescribed weight for the hammer assembly.

Next, a detailed constitution of the hammer assembly 40 will be described with reference to FIG. 2 and FIGS. 3A to 3C. In FIG. 2, the hammer assembly 40 is constituted by a hammer shank 40*a* and a pseudo hammer 40*b*, which is attached to the tip end of the hammer shank 40*a*. The weight of the pseudo hammer 40*b* can be altered by changing the size and shape thereof as well as the used material therefor. That is, like the hammer felts used in the upright piano, the pseudo hammers 40 respectively arranged for the keys 5 are gradually increased in weights in a pitch descending order from higher pitches to lower pitches. Thus, the hammer assemblies 40 are each designed to simulate the hammer assemblies of the upright piano in weights and balance positions (i.e., center of gravity). The present embodiment realizes different weights of the hammer assemblies 40 by changing externals of intermediate portions of the pseudo hammers 40, examples of which are shown in FIGS. 3A to 3C. Incidentally, the weights of the pseudo hammers 40*b* are not necessarily changed by depressing on the respective keys 5. For example, it is possible to provide the pseudo hammers 40 with different weights with respect to the low-pitch register, middle-pitch resister, and high-pitch register respectively.

Figure 4:
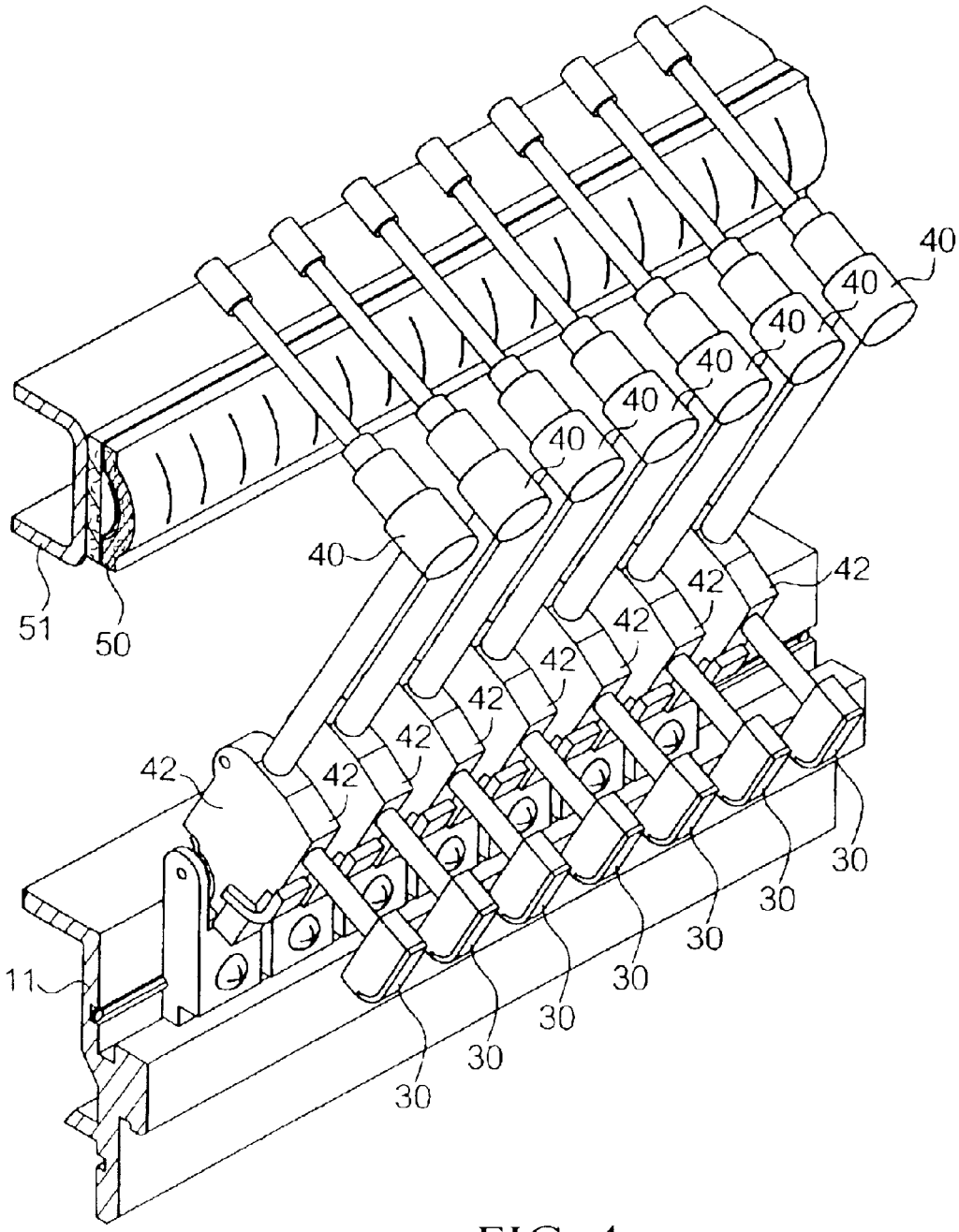
FIG. 4 is a perspective view partly in cross section showing the peripheries of a struck portion that is struck by hammer shanks of hammer assemblies.
Figure 5:
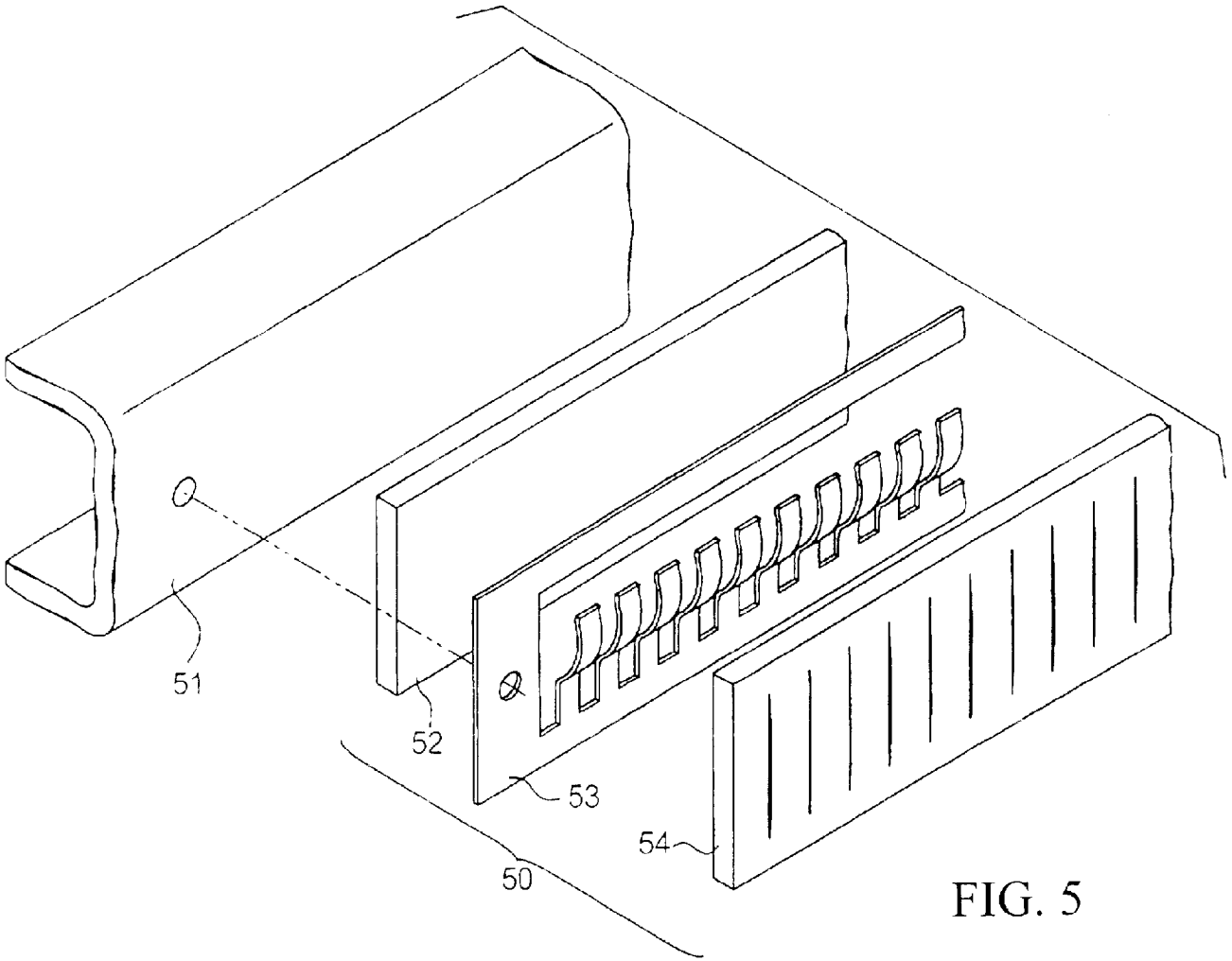
FIG. 5 is an exploded perspective view showing a detailed constitution of the struck portion including a plate spring sandwiched between buffer materials, which is attached to a hammer stop rail.

Next, a detailed constitution of the struck portion 50 will be described with reference to FIGS. 4 and 5. FIG. 4 is a perspective view showing an example of constitution regarding the peripheries of the struck portion 50 used in the keyboard structure 100, and FIG. 5 is an exploded perspective view showing the detailed constitution of the struck portion 50. In the present embodiment, the hammer shanks 40*a* of the hammer assemblies 40 are rotatably moved to strike the struck portion 50 when the keys 5 are depressed.

As shown in FIGS. 4 and 5, a hammer stop rail 51 is fixed to prescribed backend positions of the action brackets 12 and are elongated over the overall width of the keyboard structure 100 in proximity to the hammer assemblies 40. Specifically, the struck portion 50 has a triple-layered structure consisting of a buffer material 52, a plate spring 53, and a buffer material 54. Herein, the buffer materials 52 and 54 are adhered to opposite sides of the plate spring 53, which is fixed to the hammer stop rail 51 by screws. Thus, the plate spring 53 sandwiched between the buffer materials 52 and 54 is fixed to the hammer stop rail 51.

In the struck portion 50, the buffer material 52 is made of a prescribed buffer material, which is selected from among prescribed fiber materials such as the felt, urethane, leather, and cloth, or synthetic resin materials having elasticity, for example. The buffer material 52 is formed like a sheet that is elongated over the overall width of the keyboard structure 100.

Figure 6:
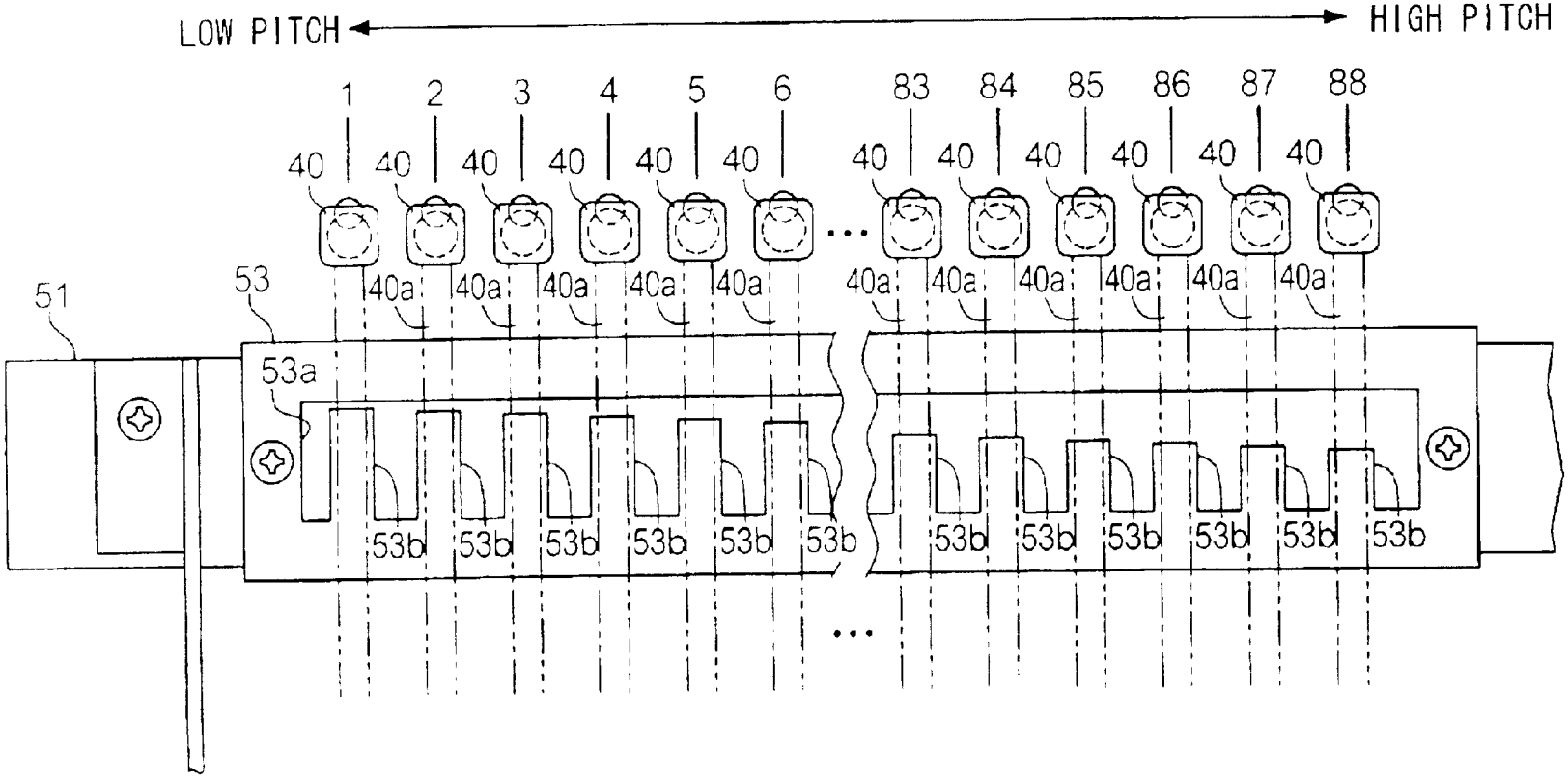
FIG. 6 is a plan view partly in cross section showing the peripheries of the plate spring, which is viewed in a direction α of the keyboard structure shown in FIG. 1.

FIG. 6 shows the peripheries of the plate spring 53, which is viewed in a direction $\alpha$ in the keyboard structure 100 shown in FIG. 1, wherein numbers ranging from '1' to '88' are numbers of the eighty-eight keys 5 for which the hammer assemblies 40 are respectively arranged.

The plate spring 53 is made of a prescribed elastic material, which is selected from among prescribed metal materials such as stainless steel, nickel silver, phosphor bronze, and brass, or synthetic resin materials having elasticity, for example. An opening 53*a* having a comb-like shape is elongated over the overall width of the keyboard structure 100, wherein in-between 'striking' areas 53*b* between comb teeth are respectively bent relative to the hammer assemblies 40.

Specifically, the aforementioned striking areas 53*b* of the plate spring 53 are arranged opposite to the hammer shanks 40*a* of the hammer assemblies 40 one by one, wherein in the side view, they are gradually curved like arcs in relation to the hammer shanks 40*a* (see FIGS. 4 and 5). Therefore, when the hammer assemblies 40 are rotatably moved to strike the struck portion 50, the striking areas 53*b* of the plate spring 53, which are arranged oppositely to the hammer assemblies 40, are slightly bent.

In the upright piano, three strings are arranged for each of the keys belonging to the high-pitch register and middle-pitch register, while one or two strings are arranged for each of the keys belonging to the low-pitch register, wherein the strings are gradually increased in thickness from higher pitches to lower pitches, so that frequencies are gradually reduced. In addition, the upright piano is designed to gradually increase the lengths of the strings in a pitch descending order from higher pitches to lower pitches. For this reason, the strings particularly used for the low-pitch register and middle-pitch register should be greatly bent when struck by the corresponding hammer felts.

Figure 7:
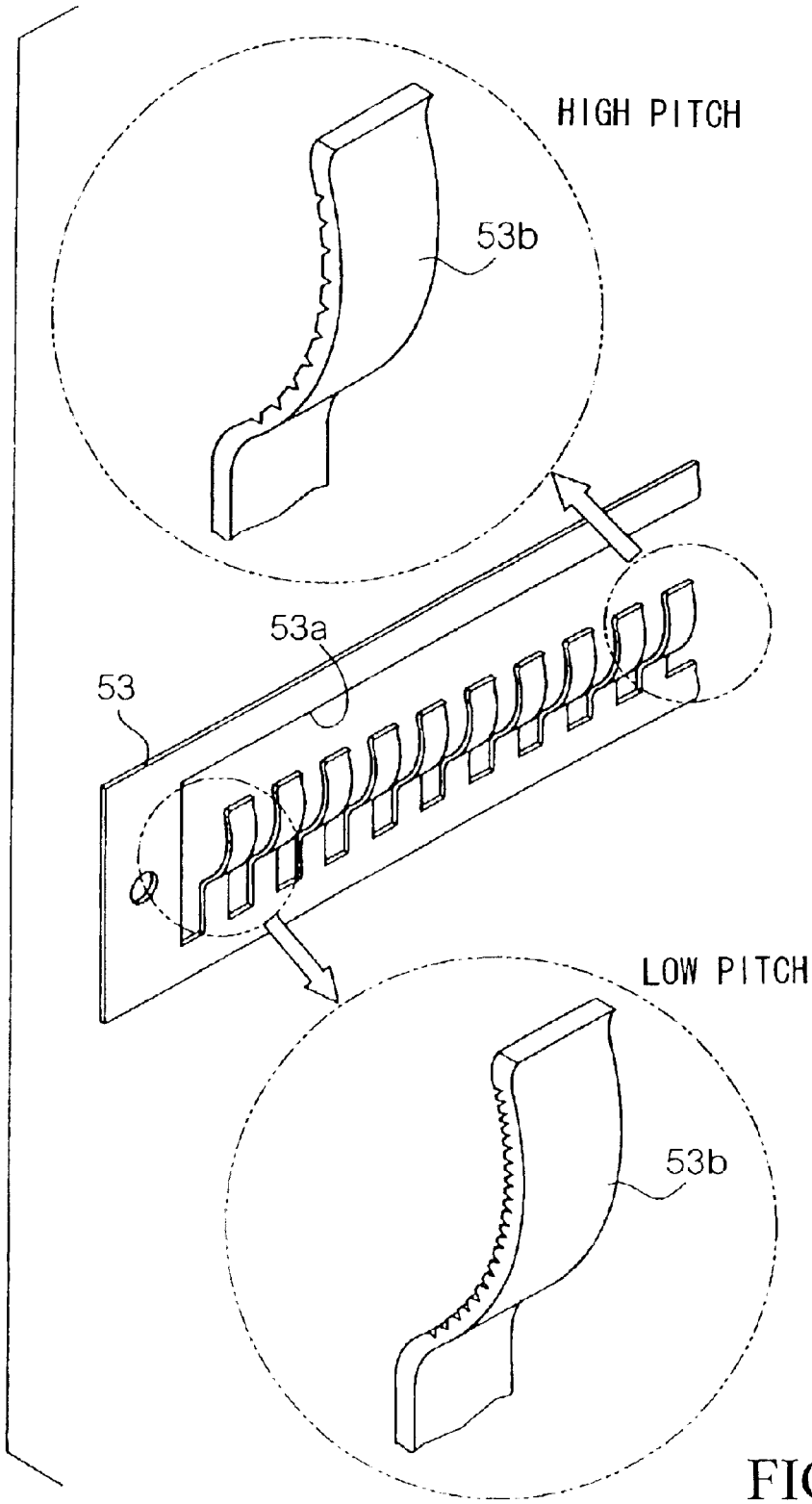
FIG. 7 is an enlarged perspective view showing details of striking areas of the plate spring that are actually struck by hammer shanks of hammer assemblies.

In order to simulate the aforementioned property of the acoustic piano, the keyboard structure 100 of the present embodiment is designed in such a way that the striking areas 53*b* of the plate spring 53 of the struck portion 50 are adequately changed in shapes each defined by the length, width, and thickness, or the plate spring 53 is adequately changed in material, for example. That is, the plate spring 53 is formed in such a way that rigidities (or spring constants) thereof are gradually decreased at the striking areas 53*b* in a pitch descending order from higher pitches to lower pitches in response to striking forces applied thereto from the hammer shanks 40*a* of the hammer assemblies 40 whose weights are gradually increased in the pitch descending order. Specifically, the present embodiment is designed as shown in FIG. 6 in such a way that the striking areas 53*b* of the plate spring 53 are gradually increased in lengths from higher pitches to lower pitches, so that spring constants thereof are gradually decreased in a pitch descending order from higher pitches to lower pitches. In addition, grooves are formed on the backsides of the striking areas 53*b* of the plate spring 53 as shown in FIG. 7 in such a way that numbers of grooves are gradually increased in a pitch descending order from high pitches to lower pitches, so that bends of the striking areas 53*b* of the plate spring 53 are gradually increased in the pitch descending order when struck by the hammer shanks 40*a*.

Each of the tip end portions of the striking areas 53*b* of the plate spring 53 is further bent to have a prescribed round shape towards the buffer material 52. Thus, it is possibly to reliably prevent the striking areas 53*b* of the plate spring 53 from being damaged even when intensely struck by the hammer shanks 40*a* and unexpectedly brought into contact with the buffer material 52.

The buffer material 54 is made of a prescribed buffer material, which is selected from among the felt, urethane, leather, cloth, and excenu, for example. Like the aforementioned buffer material 52, the buffer material 54 is shaped like a sheet elongated over the overall width of the keyboard structure 100. Unlike the buffer material 52, the buffer material 54 has 'vertical' slits that are formed in conformity with boundaries between the comb teeth of the opening 53*a* and the striking areas 53*b* of the plate spring 53, so that the buffer material 54 can be tightly attached to the striking areas 53*b* of the plate spring 53. Incidentally, it is possible to form the buffer materials 52 and 54 using different materials.

That is, the struck portion 50 can reduce striking forces applied thereto by the hammer assemblies 40 by the buffer materials 52 and 54, so that adequately reduced forces may be transmitted to the hammer assemblies 40 and the hammer stop rail 51. Thus, it is possible to realize mechanical characteristics (e.g., weights and bends) simulating the foregoing characteristics of the strings of the upright piano by the plate spring 53. Herein, the weight of a string of an upright piano is simulated by a striking force that is caused when the hammer assembly 40 strikes the struck portion 50, so that the striking force is transmitted to the key 5 as a weight factor of a string (or a key-touch response simulating the upright piano).

2. Operation of Embodiment

Next, the overall operation of the keyboard structure 100 of the electronic piano will be described in detail.

When the user (or player) depresses the key 5, the capstan 10 attached to the backend portion of the key 5 moved upwardly to rotate the whippen 20 in a clockwise direction, so that the large jack portion 23*a* of the jack 23 pushes up the butt 42 to rotate the hammer assembly 40 in a clockwise direction. Then, the hammer shank 40*a* is brought into contact with the struck portion 50. Thus, the hammer shank 40*a* of the hammer assembly 40 strikes the struck portion 50 (see FIG. 1). At this time, a sensor (not shown) detects a depressing force (or depressing velocity) of the key 5 so as to activate an electronic sound source device (not shown), which in turn produces a musical tone signal having a tone color and a tone pitch corresponding to the key 5 as well as a tone volume corresponding to the depressing force (or depressing velocity) of the key 5. The musical tone is actually produced from a speaker or a headphone set based on the musical tone signal.

While the large jack portion 23*a* rotates the hammer assembly 40, the small jack portion 23*b* comes in contact with the regulating button 28, so that the jack 23 rotates in a counterclockwise direction about the pin 24*c* with respect to the contact point between the small jack portion 23*b* and the regulating button 28, which acts as a point of application. Thus, the large jack portion 23*a* moves leftwards from the lower surface of the butt 42 in FIG. 1, so that the large jack portion 23*a* escapes from the butt 42 to allow the hammer assembly 40 to fly. After striking the struck portion 50, the hammer assembly 40 rebounds from the struck portion 50 and moves leftwards in FIG. 1 so that the catcher 30, which is attached to the butt 42 via the catcher shank 45, moves leftwards and comes in contact with the back check 31. Hence, the hammer assembly 40 is temporarily stopped. Then, the jack 23 moves downwardly being interlocked with the restoration movement of the whippen 20, which moves downwardly being interlocked with the restoration movement of the key 5. Therefore, the large jack portion 23*a* moves beneath the lower surface of the butt 42 again, which allows a next striking operation of the hammer assembly 40.

As described above, the electronic piano of the present embodiment is designed to use substantially the same keyboard structure of the conventional upright piano except the hammer assembly 40 and the struck portion 50. Therefore, it is possible to reproduce substantially the same key-touch response of the upright piano in which the jack 23 is let off and leaves off from the butt 42.

In addition, the hammer assembly 40 is designed to accurately simulate that of the upright piano by using the pseudo hammer 40*b*, by which the weight and balance position (i.e., center of gravity) of the hammer assembly 40 are adjusted. Therefore, it is possible to reproduce substantially the same key-touch response of the upright piano.

Furthermore, the plate spring 53 of the struck portion 50 is designed to simulate properties of strings of an upright piano in such a way that the striking areas 53*b* are gradually decreased in rigidities (or spring constants) in a pitch descending order from higher pitches to lower pitches and are correspondingly increased in bends (or deflections) in the pitch descending order when struck by the hammer assemblies 40. That is, it is possible to simulate weight factors and bends of strings struck by hammer felts in an upright piano. Thus, it is possible to realistically reproduce key-touch responses of an upright piano that are produced upon depression of keys causing hammer felts to strike strings.

The struck portion 50 has a triple-layered structure containing the plate spring 53 sandwiched by the buffer materials 52 and 54, wherein the plate spring 53 is fixed to the hammer stop rail 51 via the buffer material 52 by screwed, and the hammer assemblies 40 strike the plate spring 53 via the buffer material 54. This reliably reduces striking forces of the hammer assemblies 40 without damaging the hammer assemblies 40. That is, it is possible to maintain relatively high durability with respect to the hammer assemblies 40 and the struck portion 50 in the electronic piano.

The present embodiment is designed in such a way that the hammer shanks 40*a* of the hammer assemblies 40 are used to strike the struck portion 50. Therefore, compared with an example of the keyboard structure in which the pseudo hammers 40*b* of the hammer assemblies 40 are used to strike the struck portion 50, the present embodiment can reduce the depth of the keyboard structure. If the hammer assembly 40 does not strike the struck portion 50 perpendicularly, a bending moment is caused to occur about the rotation shaft of the hammer assembly 40. Compared with an example of the keyboard structure in which the pseudo hammer 40*b* of the hammer assembly 40 is used to strike the struck portion 50, the present embodiment in which the hammer shank 40*a* of the hammer assembly 40 is used to strike the struck portion 50 can move the striking point closer to the rotation shaft of the hammer assembly 40. That is, the present embodiment can reduce the bending moment when the hammer assembly 40 strikes the struck portion 50, which contributes to an improvement of the overall durability of the keyboard structure 100 including the hammer assemblies 40.

3. Modifications

This invention is not necessarily limited to the aforementioned embodiment; hence, it is possible to provide a variety of modifications, which will be described below.

(1) FIRST EXAMPLE

The hammer assembly 40 and the struck portion 50 used in the electronic piano of the aforementioned embodiment are designed to simulate both the weight factor and bend (or deflection) of a string struck by a hammer felt in an upright piano. It is possible to focus on simulation of either the weight factor of a string or the bend of a string in particular by adequately selecting a prescribed shape and/or a prescribed material for the plate spring 53. The conventional keyboard structure uses only the buffer material for the struck portion, wherein it is impossible to simulate both the weight factor and bend of a string struck by a hammer felt in an electronic piano. Therefore, even though one of them is simulated, it is possible to noticeably improve a key-touch response that the user (or player) may experience when depressing a key on an electronic piano.

(2) SECOND EXAMPLE

Figure 8:
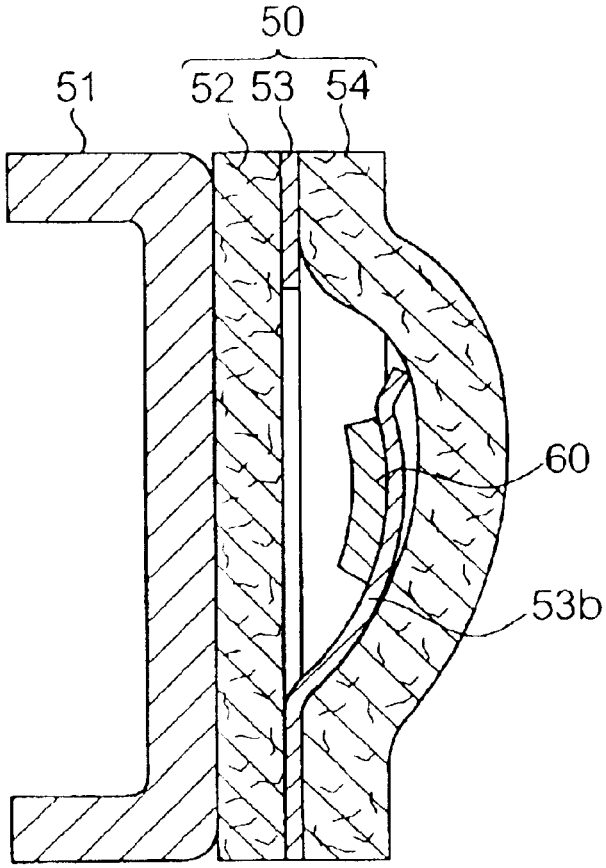
FIG. 8 is a cross sectional view showing the structure of an example of the struck portion having a weight.

The present embodiment is designed to realize variations of weights or rigidities (or spring constants) with respect to the striking areas 53*b* of the plate spring 53 of the struck portion 50 by adequately changing them in dimensions such as lengths, widths, and thickness and in materials, for example. It is possible to realize variations of weights with respect to the striking areas 53 of the plate spring 53 by adhering different weights 60 to the backsides of the striking areas 53 as shown in FIG. 8.

(3) THIRD EXAMPLE

Figure 9:
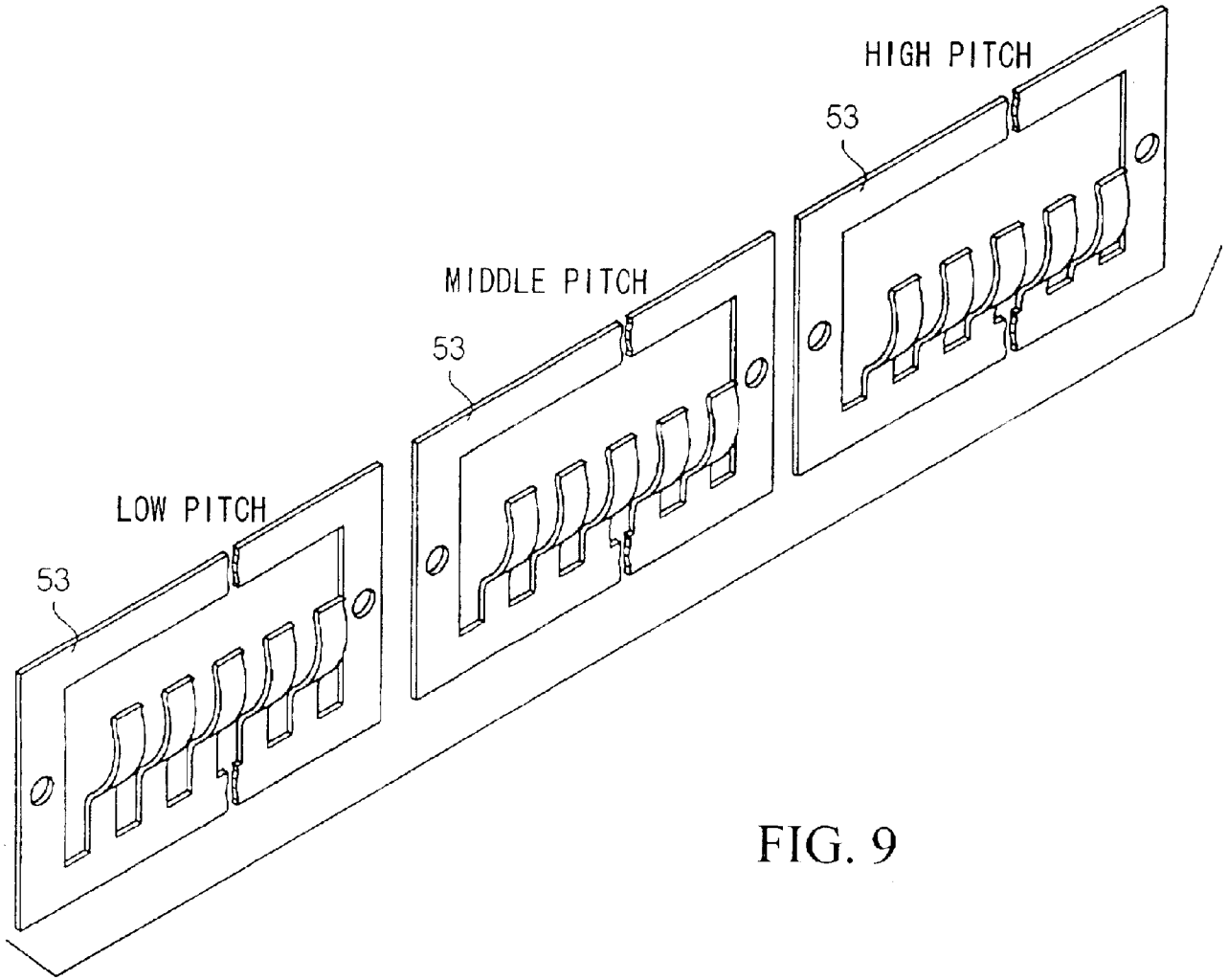
FIG. 9 is a perspective view showing an arrangement of three plate springs for use in three registers respectively.
Figure 10:
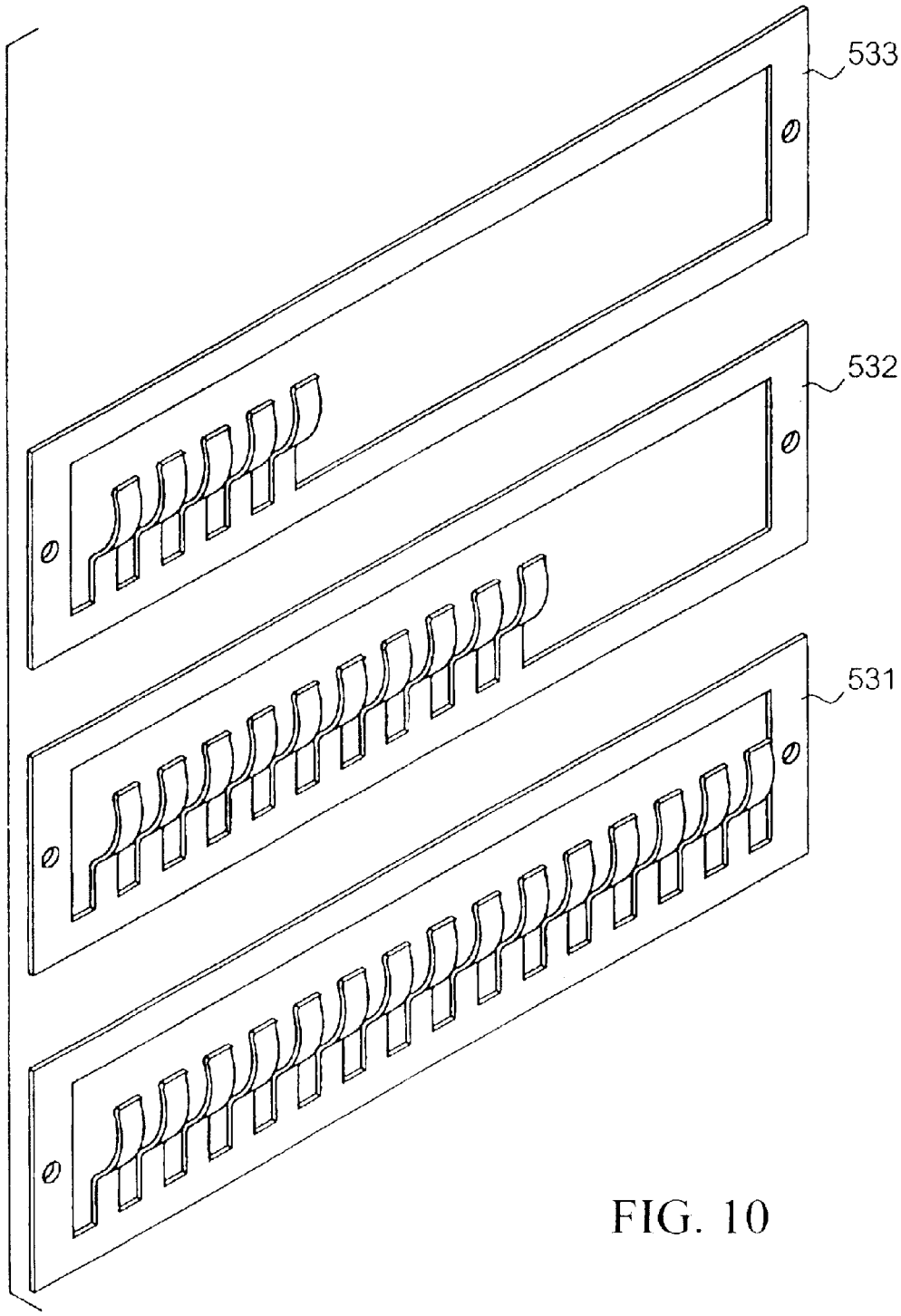
FIG. 10 is a perspective view showing three types of plate springs, which are combined together.

In the present embodiment, the struck portion 50 is constituted using only one sheet of the plate spring 53. Of course, it is possible to constitute the struck portion 50 by using multiple sheets of plate springs. For example, as shown in FIG. 9, it is possible to arrange three plate springs 53 each have the same size and shape independently for the low-pitch resister, middle-pitch register, and high-pitch register. In addition, it is possible to arrange three sheets of plate springs 531, 532, and 533 shown in FIG. 10, which are combined together in order to impart different weights to striking areas belonging to the low-pitch register, middle-pitch register, and high-pitch register respectively, so that weights of striking areas are gradually increased in a pitch descending order from higher pitches to lower pitches. Specifically, the plate spring 531 has a prescribed number of striking areas in correspondence with the hammer assemblies 40 of all the registers; the plate spring 532 has a reduced number of striking areas in correspondence with the hammer assemblies 40 of the middle-pitch register and low-pitch register; and the plate spring 533 has a further reduced number of striking areas in correspondence with the hammer assemblies 40 of only the low-pitch register. Herein, all the striking areas of the plate springs 531 to 533 can be formed in the same dimensions (i.e., the same lengths), and the integrated springs 531 to 533 also simulate the weight factor and bend of a string that vary depending on the pitch register of the keys as similar to examples and embodiments explained herein before.

(4) FOURTH EXAMPLE

In the present embodiment, the plate spring 53 of the struck portion 50 has a prescribed number of striking areas 53*b* in correspondence with the hammer assemblies 40. Instead, it is possible to integrally interconnect together all the striking areas 53*b* in the plate spring 53. Alternatively, it is possible to integrally interconnect together the striking areas 53*b* with respect to each of the three registers, i.e., low-pitch register, middle-pitch register, and high-pitch register. Even though the striking areas are integrally interconnected together with respect to each of the three registers so that substantially the same weight factors and deflections of strings of an upright piano are simulated with respect to all the registers, it is possible to noticeably improve key-touch responses upon depression of keys in comparison with the conventional keyboard structure that cannot reproduce deflections of strings struck by hammer felts in an electronic piano.

In the above, it is possible to simulate variations of deflections of strings by changing elastic materials for use in integrally interconnected striking areas regarding the three registers respectively.

Instead of changing elastic materials, or in addition to changing elastic materials, it is possible to perform boring processes on the integrally interconnected striking areas of the plate spring, so that it is possible to simulate variations of deflections of strings struck by hammer felts in an electronic piano and variations of weight factors transmitted to keys when depressed depending on the pitch register of the keys.

(5) FIFTH EXAMPLE

Figure 11:
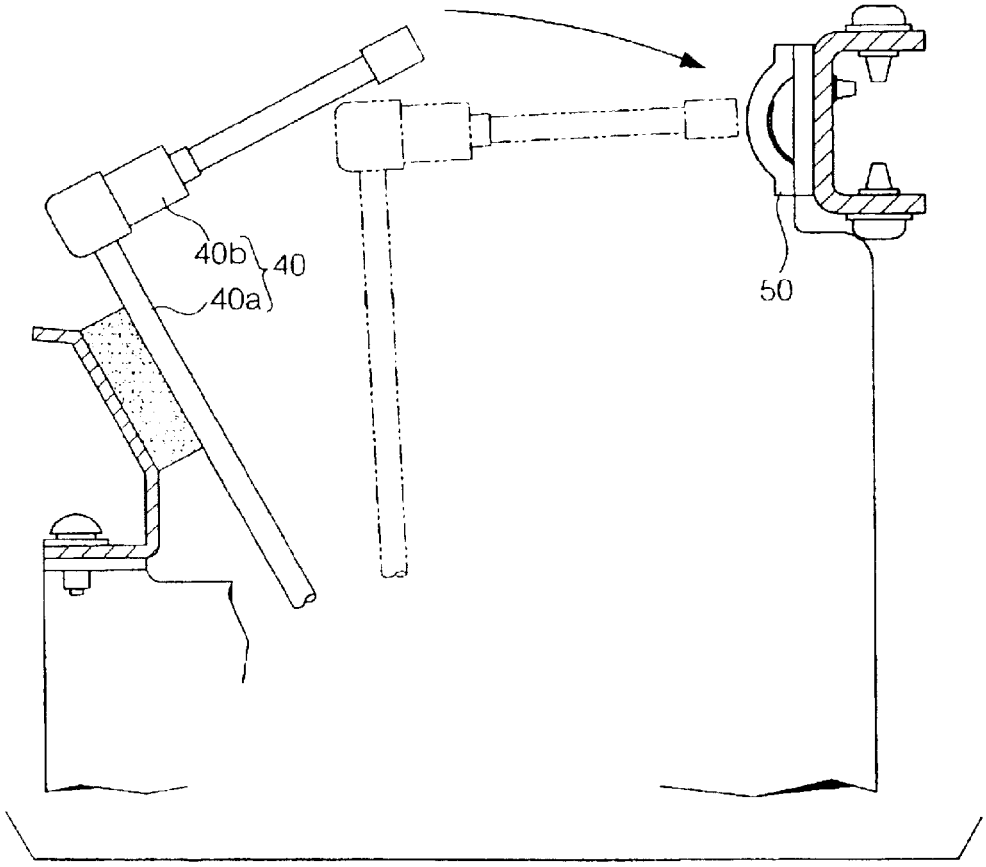
FIG. 11 is a side view partly in cross section showing a modified example of the hammer assembly in which a pseudo hammer strikes the struck portion.
Figure 12:
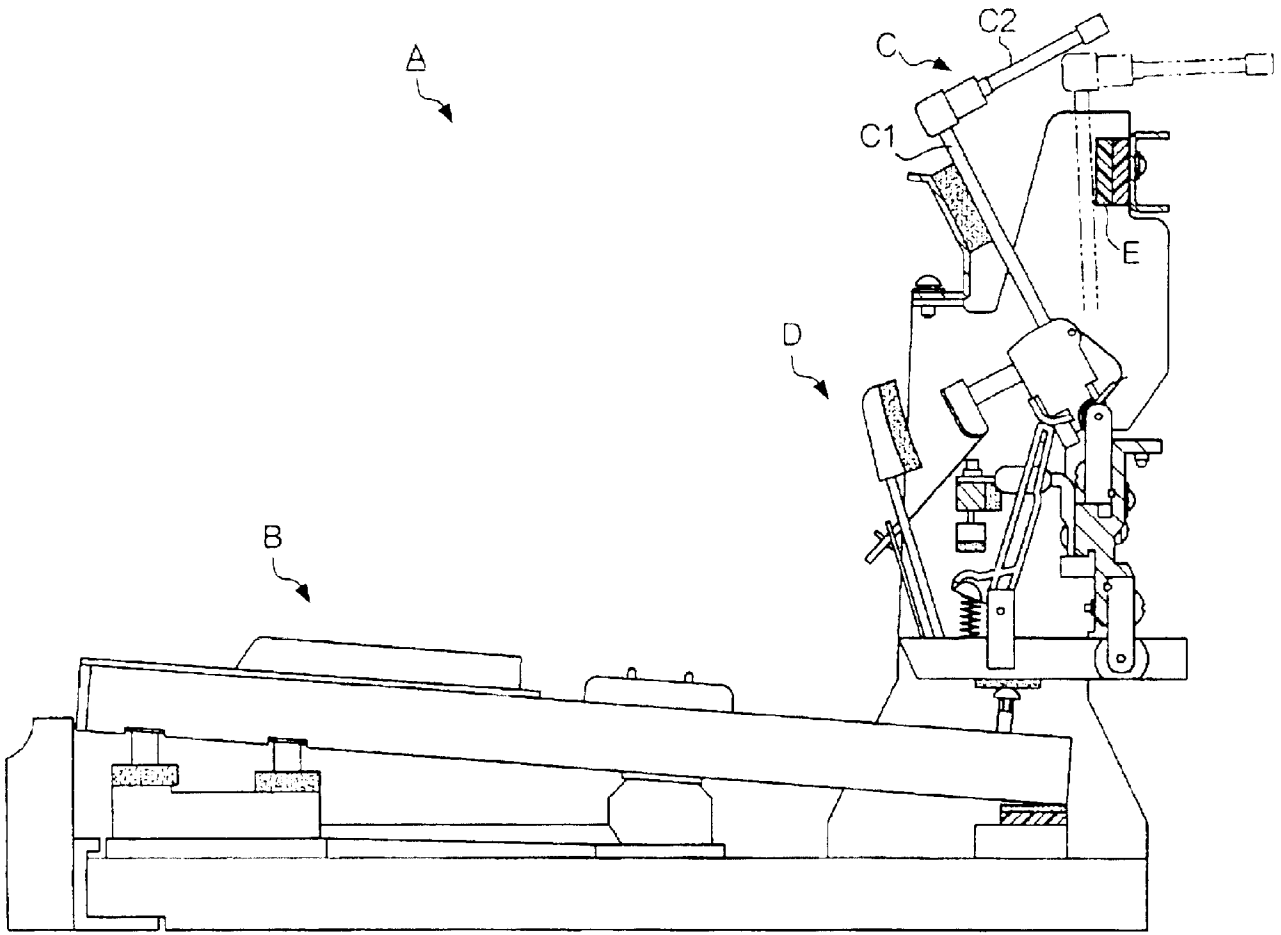
FIG. 12 is a side view partly in cross section showing an example of a keyboard structure of an electronic piano.

The present embodiment is designed in such a way that the hammer shanks 40*a* of the hammer assemblies 40 are used to strike the struck portion 50. Of course, it is possible to modify the present embodiment in such a way that the pseudo hammers 40*b* are used to strike the struck portion 50 as shown in FIG. 11.

(6) SIXTH EXAMPLE

The present embodiment employs the keyboard structure 100, which is basically identical to the keyboard structure of an upright piano except the hammer assemblies 40 and the struck portion 50, in order to reproduce substantially the same key-touch responses of an upright piano. Of course, it is possible to modify the present embodiment to use another type of the keyboard structure, such as the keyboard structure of a grand piano, so that it is possible to reproduce substantially the same key-touch responses of a grand piano. This invention is not necessarily limited to keyboard structures for use in pianos. Therefore, this invention is applicable to other types of keyboard structures for use in cembalos, celestas, and organs as well as training musical instruments, for example.

As described heretofore, this invention has a variety of technical features and effects, which will be described below.

(1) This invention provides a keyboard structure that is basically identical to the known keyboard structure of a prescribed musical instrument such as an upright piano except for hammer assemblies and peripheries, thus simulating real key-touch responses in an electronic piano, for example. Each of the hammer assemblies is constituted by a hammer shank and a pseudo hammer, one of which is used to strike a struck portion that is attached to a prescribed backend portion of an action bracket, wherein the struck portion is formed in a multi-layered structure containing an elastic member (e.g., a plate spring) sandwiched by buffer materials. Therefore, when the hammer assembly strikes the struck portion in response to a depression of a key, an elastic deformation is caused to occur on the elastic member, which may reproduce substantially the same deflection of a string that is struck by a hammer felt in an upright piano, for example. In addition, the striking force of the hammer assembly is reduced by the buffer materials, so that it is possible to maintain a relatively high durability with respect to both the hammer assemblies and the struck portion.

(2) The elastic member has at least one striking area that is actually struck by a hammer assembly upon depression of a key and that is curved relative to the hammer assembly. Due to the curved shape, the striking area of the elastic member can be adequately deformed when struck by a hammer assembly, so that it is possible to reproduce substantially the same deflection of a string struck by a hammer felt in an upright piano.

(3) A prescribed number of striking areas are formed in the elastic member in correspondence with all the hammer assemblies or in correspondence with prescribed groups (e.g., registers) of hammer assemblies respectively. Thus, it is possible to realize variations of deflections of striking areas struck by corresponding hammer assemblies in such a way that deflections are gradually increased in a pitch descending order from higher pitches to lower pitches. Specifically, striking areas of the elastic member are changed in shapes and/or dimensions such as lengths, or they are changed in materials, for example.

(4) In the above, grooves are formed on backsides of striking areas in order to realize variations of deflections when struck by hammer assemblies upon depression of keys. Striking areas can be gradually increased in weights in a pitch descending order from higher pitches to lower pitches. In addition, the buffer materials can be made of prescribed fiber materials, leather materials, or synthetic resins having elasticity.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A keyboard instrument comprising:

a plurality of keys;

a plurality of hammer assemblies that are rotatably moved upon depression of the keys;

a plurality of struck portions arranged in association with the plurality of hammer assemblies, wherein each of the plurality of struck portions is varied in property depending on a pitch or a pitch register of a key when struck by the hammer assembly;

a plurality of action mechanisms for transmitting operations of the keys to the hammer assemblies.

2. A keyboard instrument according to claim 1, wherein each of the plurality of struck portions is varied in the property to simulate a weight factor or a bend of a string used in an acoustic keyboard instrument.

3. A key board instrument according to claim 1, wherein each of the hammer assemblies is constituted by a hammer shank and a pseudo hammer, one of which is used to strike the struck portion upon depression of each of the keys.

4. A keyboard instrument according to claim 1, wherein the struck portion contains an elastic member that is made of a prescribed material selected from among stainless steel, nickel silver, phosphor bronze, brass, and elastic synthetic resin.

5. A keyboard instrument according to claim 1, wherein the struck portion has a multilayer structure including an elastic member comprising at least one striking area whose deflection is varied when struck by the hammer assemblies upon depression of the keys having different pitches.

6. A keyboard instrument according to claim 1, wherein the struck portion has a triple-layered structure including an elastic member sandwiched between buffer materials, which are made of a prescribed material selected from among felts, urethanes, leathers, cloths, and elastic synthetic resins, and wherein the elastic member is constituted by a plate spring comprising at least one striking area whose deflection is varied when struck by the hammer assemblies upon depression of the keys having different pitches.

7. A keyboard instrument according to claim 5 or 6, wherein the at least one striking area of the elastic member is curved relative to the hammer assemblies.

8. A keyboard instrument according to claim 5 or 6, wherein the elastic member comprises a plurality of striking areas, which are curved relative to the hammer assemblies with respect to prescribed groups of the keys or with respect to the plurality of keys respectively and wherein the striking areas are gradually increased in deflections in a pitch descending order from higher pitches to lower pitches when struck by the hammer assemblies.

9. A keyboard instrument according to claim 8, wherein the striking areas are gradually increased in deflections in the pitch descending order by changing materials therefore.

10. A keyboard instrument according to claim 8, wherein the striking areas are gradually increased in deflections in the pitch descending order by gradually increasing dimensions thereof in the pitch descending order.

11. A keyboard instrument according to claim 8, wherein the striking areas are gradually increased in deflections in the pitch descending order by gradually decreasing spring constants in the pitch descending order.

12. A keyboard instrument according to claim 8, wherein grooves are formed on backsides of the striking areas of the elastic member.

13. A keyboard instrument according to claim 8, wherein the striking areas are gradually increased in deflections in the pitch descending order by gradually increasing weights thereof in the pitch descending order.

14. A keyboard for an electronic musical instrument, the keyboard comprising:

at least a first plurality of keys, each key corresponding to a respective pitch;

at least a first plurality of hammer assemblies, each of the hammer assemblies of the first plurality being associated with a respective one of the keys of the first plurality, each hammer assembly being rotated upon depression of its associated key;

at least a first plurality of struck portions, each of the struck portions being associated with a respective one of the hammer assemblies and therefore with a respective one of the keys, each struck portion being struck by its associated hammer assembly when its associated key is depressed, each struck portion having a rigidity which varies relative to the rigidity of the other struck portions as a function of the pitch of its associated key; and at least a first plurality of action mechanisms, each action mechanism being associated with a respective one of the keys, and therefore a respective one of the hammer assemblies and a respective one of the struck portions, each of the action mechanisms transmitting movement of its associated key to its associated hammer assembly.

15. A keyboard according to claim 14, wherein the rigidity of each of the struck portions is selected to simulate a weight factor and/or a bend of a string used in an acoustic keyboard instrument.

16. A keyboard according to claim 14, wherein each of the hammer assemblies comprises a hammer shank and a pseudo hammer, one of which is used to strike its associated struck portion upon depression of its associated key.

17. A keyboard according to claim 14, wherein each of the struck portions contains an elastic member that is made of a material selected from among stainless steel, nickel silver, phosphor bronze, brass, and elastic synthetic resin.

18. A keyboard according to claim 14, wherein each of the struck portions includes an elastic member, the rigidity of each of the elastic portions being a function of the pitch of its associated key.

19. A keyboard according to claim 14, wherein each of the struck portions has a triple-layered structure including an elastic member sandwiched between buffer materials, the buffer materials being made of a material selected from among felts, urethanes, leathers, cloths, and elastic synthetic resins, the elastic member comprises a plate spring, the rigidity of the spring plate being a function of a pitch of its associated key.

20. A keyboard according to claim 18 or 19, wherein the striking area of each of the stuck portions is curved relative to a striking surface of its associated hammer assembly.

21. A keyboard according to claim 18 or 19, wherein the pitch of the keys varies in descending order and the rigidity of the striking areas corresponding to the keys also varies in descending order.

22. A keyboard according to claim 21, wherein the rigidity of the respective striking areas is varied by varying the materials of which the respective striking areas are made.

23. A keyboard according to claim 21, wherein the rigidity of the respective striking areas are varied by varying the dimensions of the respective striking areas.

24. A keyboard according to claim 21, wherein the rigidity of the respective striking areas are varied by varying the spring constants of the respective striking areas.

25. A keyboard according to claim 21, wherein grooves are formed on backsides of the striking areas.

26. A keyboard according to claim 21, wherein the rigidity of the respective striking areas are varied by varying weights coupled to the respective striking areas.

27. A keyboard according to claim 14, wherein the plurality of striking areas are formed as part of a single elastic member.

28. A keyboard according to claim 14, wherein the keys are grouped into respective pitch registers and where the striking areas for all of the keys corresponding to the notes in a given pitch register are formed as part of a single elastic member for that pitch register.

29. A keyboard according to claim 14, further including sensors for sensing the fact that the keys have been depressed.

* * * * *